US006007323A

United States Patent [19]

Kurata

[11] Patent Number: 6,007,323

[45] Date of Patent: Dec. 28, 1999

[54] COMBUSTION METHOD

[76] Inventor: Tadao Kurata, 3-7-2, Nishiooizumi, Tokyo, Japan

[21] Appl. No.: 09/245,082

[22] Filed: Feb. 5, 1999

[51] Int. Cl.[6] ..... F23L 9/00

[52] U.S. Cl. ..... 431/2

[58] Field of Search ..... 431/2

[56] References Cited

U.S. PATENT DOCUMENTS

| | | | |
|---|---|---|---|
| 3,844,716 | 10/1974 | Noakes | 431/2 |
| 4,806,485 | 2/1989 | Birks et al. | 422/70 |
| 5,242,835 | 9/1993 | Jensen | 422/82.05 |

*Primary Examiner*—Carroll Dority

*Attorney, Agent, or Firm*—Shlesinger, Arkwright & Garvey, LLP

[57] ABSTRACT

There is described a combustion method which completely incinerates substances to be burned, particularly non-industrial wastes and industrial wastes, without involvement of generation of harmful substances. Under the combustion method, a portion of or substantially all triplet oxygen molecules involved in combustion are excited to singlet oxygen molecules, and substances to be burned are incinerated in the presence of singlet oxygen. Microwave discharge or photosensitization reaction is employed for exciting triplet oxygen to singlet oxygen.

4 Claims, No Drawings

COMBUSTION METHOD

BACKGROUND OF THE INVENTION

1. Field of the Invention

The present invention relates to a method for incinerating substances, and more particularly, to a combustion method suitable for incinerating non-industrial wastes and industrial wastes.

2. Description of the Related Art

Incineration of a substance is usually carried out by means of a high-temperature oxidative reaction between oxygen contained in air and the substance, and therefore the presence of oxygen-containing air is indispensable for combustion. Air surrounding the planet has been considered to be formed during the course of a long history of evolution from the Genesis era. The era at which air has become substantially equal in composition to that at the present time, particularly, the time when the oxygen content of air substantially reached its oxygen current level, is not known with certainty. At least in terms of atmospheric composition, it is believed that there is not much difference between air that existed at the time when the human beings emerged and air that exists now. Primitive men should have observed, as one type of natural phenomenon, combustion in such forms as spontaneous ignition typified by a forest fire. Combustion per se is a natural phenomenon which has been well known since time immemorial. Since primitive man mastered fire, which is considered to have taken place far back into the prehistoric period, the techniques for mastering fire have probably been utilized actively, as combustion method, for the sake of our lives.

Although the majority of substances are completely burned during the course of combustion and are converted to stable oxides, some of the substances are incompletely burned and yield various types of volatile, less-volatile, and nonvolatile products. For example, when organic substances, such as ordinary organic compounds, are completely burned, water and carbon dioxides are largely produced. More specifically, when cellulose which is the principal constituent of paper or soybean oil is completely burned, water and carbon dioxides are produced. In contrast, if the cellulose or soybean oil is incompletely burned, various types of unburned substances, e.g., carbon monoxides, aldehyde, and soot are exhausted and a polynuclear aromatic compound, such as pyrene, is produced from the cellulose. Tobacco smoke and exhaust gas from a car are also known to contain various types of products resulting from incomplete combustion.

Unburned products contain substances deleterious to the global environment or human health. Particularly, toxic substances which are also known as environmental hormone and act as endocrine disturbing chemicals, such as dioxin, are produced in an incinerator as a result of incineration of wastes at insufficient temperatures. Serious environmental pollution caused by such toxic substances have recently been considered a global social problem. All the countries of the world, including Japan, are required to take immediately measures against such pollution.

In light of the present situation set forth, the object of the present invention is to provide a combustion method, by which substances to be incinerated, particularly, non-industrial wastes and industrial wastes, are completely burned without involvement of generation of harmful substances.

SUMMARY OF THE INVENTION

Oxygen which is contained in air and contributes to ordinary combustion has a multi-electron system in a stable ground state. Air is well known, the ground state of an oxygen molecules has a spin quantum number of one and hence corresponds to a multiplet state of spin degeneracy 3. Oxygen molecules in a triplet state (hereinafter referred to as "triplet oxygen") are stable and are utilized for respiration by creatures. Triplet oxygen molecules are indispensable for sustaining the life of creatures in the planet, including human beings. Through breathing, a human acquires energy by oxidation of constituents of food, such as sugar, lipids, proteins, and the like. An oxidation process associated with generation of biological energy may be deemed a combustion process which proceeds in a very mild manner.

Oxygen molecules in a singlet state, i.e., an excited state, (hereinafter referred to as "singlet oxygen") are highly reactive and have a short chemical life. Therefore, ordinary air contains few singlet oxygen molecules. In a case where triplet oxygen is converted to singlet oxygen in a laboratory, photosensitization utilizing a relevant coloring agent is common. Various reactions by singlet oxygen considerably differ from those by triplet oxygen, and hence products resulting from oxidation of a substance by singlet oxygen also considerably differ from products resulting from oxidation of a substance by triplet oxygen.

Accordingly, to solve the foregoing problem, the present invention provides a method of converting a portion of or substantially all the triplet oxygen molecules involved in combustion into singlet oxygen molecules and induces combustion of substances to be burned in the presence of singlet oxygen molecules.

Microwave discharge or photosensitive reaction is employed for exciting triplet oxygen to singlet oxygen.

Singlet oxygen has an energy level of only 22.5 kcal/mol higher than that of triplet oxygen in the ground state and is unstable and highly reactive. When a substance to be burned is incinerated in the presence of highly reactive singlet oxygen, the substance can be completely burned at temperatures lower than that required for burning it in the presence of triplet oxygen.

Further, under the same conditions, a substance to be burned is more efficiently incinerated by singlet oxygen than by triplet oxygen.

DETAILED DESCRIPTION OF THE PREFERRED EMBODIMENT

Utilization of singlet oxygen for combustion reactions, e.g., incineration of industrial wastes, requires generation of a massive amount of singlet oxygen in a short period of time and a continuous supply of singlet oxygen to a combustion furnace. Utilization of microwave discharge is suitable for producing from triplet oxygen singlet oxygen to be used for combustion reaction. Singlet oxygen is produced by microwave discharge by feeding, e.g., a triplet-oxygen-containing gas, into a hollow resonator together with a rare gas, and by application of an electric field of frequency on the order of hundreds of mega-hertz to tens of giga-hertz to the hollow resonator. As is experimentally acknowledged, singlet oxygen can be sustained in an excited state for about 45 minutes in a vacuum. Accordingly, singlet oxygen is changed to a lean gas to a certain extent, thereby enabling sustainment of the life of singlet oxygen. As a result, sufficient amount of time can be ensured to introduce the singlet oxygen to the combustion chamber. Microwave discharge is a physical means that employs electronic energy and is practical because it enables generation of singlet oxygen through the use of only a vapor phase system. The thus-generated singlet oxygen is immediately introduced into the combustion chamber so as to contribute to combustion reaction, thereby enabling implementation of the present invention. When the present invention is worked, singlet oxygen and triplet oxygen may be mixed in appropriate proportions, as required, according to conditions of substances to be burned and the combustion furnace. Further, combustion may be carried out while the proportion of singlet oxygen to triplet oxygen is changed during the course of combustion.

A practical reaction will now be described. In combustion reaction of triplet oxygen, which has a di-radical structure (•O—O•) and is in a ground state, various atoms and radicals are produced in a flame. Particularly, during combustion of hydro carbon, combustion reaction proceeds in a chained manner through various reactions such as abstraction reaction of hydrogen. In contrast, in combustion reaction of singlet oxygen that is in an excited state, active contribution of singlet oxygen to chain reaction of radicals is not observed. However, singlet oxygen is originally an electrophilic reagent and is prone to react with a substance having a greater electron donative characteristic. Accordingly, in contrast with triplet oxygen, which is liable to react with radicals, singlet oxygen is prone to induce two-electron reaction. For example, singlet oxygen is able to actively induce reactions which are difficult to induce by triplet oxygen, such as direct addition to a double bond and generation of dioxetane. Thus, the combustion method utilizing singlet oxygen according to the present invention enables incineration by use of only singlet oxygen as one mode to carry out the invention. More preferably, attaining ideal combustion conditions by optimum combination of singlet oxygen and triplet oxygen and by means of complementary combustion reactions characterized respectively by singlet oxygen and triplet oxygen in coexistence can be said to be more desirable.

Although singlet oxygen is well known for its participation in photosensitization reaction, little singlet oxygen is used industrially. Singlet oxygen has thus far never been utilized for combustion reactions. In photosensitization reaction, triplet oxygen in a ground state is transformed into singlet oxygen by acquisition of energy from excited coloring matters, thereby inducing various oxidation reactions. More specifically, singlet oxygen is produced by dissolving a coloring matter (or a photosensitive agent) such as rose bengal into a relevant solvent such as water or alcohol to thereby prepare a solution, and by exposure of the solution to a visible light ray while triplet oxygen is supplied to the solution. Alternatively, singlet oxygen may be produced by reaction of hydrogen peroxide with hypochlorite. As a matter of course, singlet oxygen produced by utilization of such a liquid-phase chemical means may be recovered and introduced into the combustion furnace so as to be used for combustion reaction.

Singlet oxygen is not in principle considerably different from triplet oxygen in terms of combustion procedures and combustion systems. Combustion can be carried out by introduction of an appropriate amount of singlet oxygen into an air (i.e. triplet oxygen) supply system connected to a conventional combustion system. However, combustion reactions using singlet oxygen completely differs from combustion reactions using triplet oxygen. Therefore, in designing a combustion system, consideration must be given to the difference in caloric power and combustion efficiency between combustion by singlet oxygen and combustion by triplet oxygen. In addition, in view of the characteristics of singlet oxygen, such as its extremely high reactivity, consideration must also be given to safety provisions against durability of the combustion system and prevention of leakage of singlet oxygen. Further, it goes without saying that conditions may vary according to the chemical properties of the substances to be burned.

To maintain a superior utilization factor of singlet oxygen, the singlet oxygen generator is desirably located in sufficiently close proximity to the combustion system. A high-speed air blower may be utilized in order to cause generated singlet oxygen to contribute to combustion as soon as possible. More preferably, a singlet oxygen generator may be integrally built into the combustion system.

Under the combustion method according to the present invention, combustion which is superior in performance to combustion realized by a conventional combustion system may be effected by combustion of substances to be burned while ordinary triplet oxygen is replaced with or combined with singlet oxygen. For example, dioxin is said to form as a result of incomplete combustion, such as incineration at a low temperature of 800° C. or less. Utilization of singlet oxygen enables complete combustion even in the case of low-temperature incineration, thus preventing effluence of harmful substances. Further, because of the highly reactive characteristic of singlet oxygen, combustion reaction proceeds immediately, thereby resulting in an increase in combustion efficiency, a reduction in combustion time, and savings in fuel. Furthermore, superior combustion efficiency is also expected to contribute to an increase in generation of recyclable heat and a significant reduction in the amount of solid residues, which would otherwise result from combustion. It is also expected to result in an increase in workability of combustion processes, which in turn would contribute to reduction in personnel expenditures.

Although working of the present invention involves energy to be used for producing singlet oxygen and facilities for producing singlet oxygen, the expenditures incurred may be sufficiently offset by improvement in efficient combustion. This can be implemented by the present invention as set forth. In terms of environmental protection, a combustion system which does not involve generation of harmful substances is of considerably greater social significance than is any other.

What is claimed is:

1. A combustion method, wherein oxygen is excited from the triplet state to the singlet state, and substances to be burned are incinerated in the presence of the thus-excited singlet oxygen.

2. A combustion method, wherein oxygen is excited from the triplet state to the singlet state, and substances to be burned are incinerated in mixed presence of the thus-excited singlet oxygen and triplet oxygen.

3. The combustion method as defined in claim 1 or 2, wherein microwave discharge is used for exciting oxygen from the triplet state to the singlet state.

4. The combustion method as defined in claim 1 or 2, wherein photosensitive reaction is used for exciting oxygen from the triplet state to the singlet state.

* * * * *

UNITED STATES PATENT AND TRADEMARK OFFICE

CERTIFICATE OF CORRECTION

PATENT NO. : 6,007,323
DATED : December 28, 1999
INVENTOR(S) : Tadao KURATA

It is certified that error appears in the above-indentified patent and that said Letters Patent is hereby corrected as shown below:

On the title page, please add,

-- Foreign Priority Data

July 16, 1998 [JP] Japan... 10-201404 --

Signed and Sealed this

Eighth Day of August, 2000

*Attest:*

*Attesting Officer*

Q. TODD DICKINSON

*Director of Patents and Trademarks*